US009227297B2

(12) United States Patent
Rahmathullah et al.

(10) Patent No.: US 9,227,297 B2
(45) Date of Patent: Jan. 5, 2016

(54) RETAINING RING WITH ATTACHABLE SEGMENTS

(71) Applicant: Applied Materials, Inc., Santa Clara, CA (US)

(72) Inventors: Irfanulla Khuddus Rahmathullah, Bangalore (IN); Bopanna Ichettira Vansantha, Bangalore (IN); Padma Gopalakrishnan, Fremont, CA (US); Abraham Palaty, Thrissur (IN); Aswathnarayanaiah Ravi, Bangalore (IN); Ashish Bhatnagar, Fremont, CA (US); Young J. Paik, Campbell, CA (US); Stacy Meyer, San Jose, CA (US); Daniel Martin, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 14/219,913

(22) Filed: Mar. 19, 2014

(65) Prior Publication Data

US 2014/0287662 A1 Sep. 25, 2014

Related U.S. Application Data

(60) Provisional application No. 61/803,619, filed on Mar. 20, 2013.

(51) Int. Cl.
*B24B 37/30* (2012.01)
*B24B 37/32* (2012.01)

(52) U.S. Cl.
CPC ..... *B24B 37/32* (2013.01)

(58) Field of Classification Search
CPC ..... B24B 37/30; B24B 37/32; B24B 41/06; B24B 41/061; B24B 41/062
USPC ..... 451/398, 285–290
See application file for complete search history.

(56) References Cited

U.S. PATENT DOCUMENTS

| | | | | |
|---|---|---|---|---|
| 4,031,769 | A * | 6/1977 | Kassing | 474/162 |
| 4,441,741 | A * | 4/1984 | Galle, Jr. | 285/18 |
| 6,019,670 | A * | 2/2000 | Cheng et al. | 451/56 |
| 6,068,548 | A | 5/2000 | Vote et al. | |
| 6,183,354 | B1 | 2/2001 | Zuniga et al. | |
| 6,224,472 | B1 * | 5/2001 | Lai et al. | 451/398 |
| 6,267,643 | B1 * | 7/2001 | Teng et al. | 451/41 |
| 6,390,905 | B1 * | 5/2002 | Korovin et al. | 451/286 |
| 6,436,228 | B1 * | 8/2002 | Zuniga et al. | 451/285 |
| 6,454,637 | B1 * | 9/2002 | Gotkis | 451/287 |
| 6,676,497 | B1 * | 1/2004 | Chen et al. | 451/288 |
| 6,962,520 | B2 * | 11/2005 | Taylor | 451/41 |
| 7,520,795 | B2 * | 4/2009 | Wang et al. | 451/36 |
| 7,575,504 | B2 | 8/2009 | Zuniga et al. | |
| 8,517,803 | B2 * | 8/2013 | Sather et al. | 451/286 |
| 2005/0037690 | A1 * | 2/2005 | Heidrich et al. | 451/5 |
| 2006/0240750 | A1 * | 10/2006 | Oh et al. | 451/285 |
| 2007/0224864 | A1 * | 9/2007 | Burns et al. | 439/164 |
| 2012/0184189 | A1 * | 7/2012 | Kim et al. | 451/388 |
| 2012/0309276 | A1 * | 12/2012 | Kim | 451/364 |

* cited by examiner

*Primary Examiner* — George Nguyen
(74) *Attorney, Agent, or Firm* — Fish & Richardson P.C.

(57) ABSTRACT

A retaining ring includes a generally annular upper portion having a top surface configured to be connected to a base of a carrier head and a lower surface, and a plurality of substantially identical arcuate segments detachably secured to the upper portion to form an annular lower portion. Each of the arcuate segments has an upper surface that abuts the lower surface of the upper portion and a bottom surface for contacting a polishing pad during polishing.

21 Claims, 4 Drawing Sheets

RETAINING RING WITH ATTACHABLE SEGMENTS

CROSS-REFERENCE TO RELATED APPLICATIONS

This application claims priority to U.S. application Ser. No. 61/803,619, filed on Mar. 20, 2013, which is incorporated by reference.

TECHNICAL FIELD

The present disclosure relates to a retaining ring for a carrier head for chemical mechanical polishing.

BACKGROUND

Integrated circuits are typically formed on substrates, particularly silicon wafers, by the sequential deposition of conductive, semiconductive or insulative layers. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad.

The substrate is typically retained below the carrier head by a retaining ring. However, because the retaining ring contacts the polishing pad, the retaining ring tends to wear away, and is occasionally replaced. Some retaining rings have an upper portion formed of metal and a lower portion formed of a wearable plastic, whereas some other retaining rings are a single plastic part.

SUMMARY

In one aspect, a retaining ring includes a generally annular upper portion having a top surface configured to be connected to a base of a carrier head and a lower surface, and a plurality of substantially identical arcuate segments detachably secured to the upper portion to form an annular lower portion. Each of the arcuate segments has an upper surface that abuts the lower surface of the upper portion and a bottom surface for contacting a polishing pad during polishing.

Implementations may include one or more of the following features. The upper portion may have a plurality of apertures, and each of the arcuate segments may include a projection extending from the top surface into an aperture of the plurality of apertures. A threaded fastener may be inserted into the aperture. The fastener may engage a threaded recess in the projection. The projection may be a cylindrical shank. The upper portion may have a plurality of recesses, and each of the arcuate segments may include a raised portion that engages a recess of the plurality of recesses. The raised portion may surround the projection. The retaining ring may include a plurality of slurry-transport channels, and there may be one arcuate segment for each slurry transport channel. Each arcuate segment may extend between two adjacent slurry transport channels. At least one side surface of the arcuate segment may include a ledge with a lower surface that is recessed relative to the bottom surface. Each arcuate segment may be a first material, and the upper portion may be a different second material. The second material may be more rigid than the first material. Each arcuate segment may be a plastic selected from the group consisting of polyphenylene sulfide (PPS), polyaryletherketone (PAEK), polyetheretherketone (PEEK) and polyetherketoneketone (PEKK). The lower portion may lack any aperture from the top surface to the bottom surface of the lower portion. The top surface of the upper portion may include a hole to receive a fastener to mechanically affix the retaining ring to the base.

Implementations may include one or more of the following advantages. The retaining ring can be easy to assemble, and thus can be manufactured at low cost. Worn segments can be easily removed and replaced, permitting the backing ring new segments to be attached to the backing ring The details of one or more implementations are set forth in the accompanying drawings and the description below. Other aspects, features, and advantages will be apparent from the description and drawings, and from the claims.

DETAILED DESCRIPTION

Retaining rings can be expensive, and as noted above, need to be periodically replaced when worn. The bottom of the retaining ring that contacts the polishing pad is formed of a plastic, but due to constraints, e.g., degree of rigidity, wear rate, chemical resistance, and the like needed for the bottom of the retaining ring, the selection of suitable plastic compositions is limited, and thus the plastic can be fairly expensive. A technique is to assemble the retaining ring from multiple lower segments that are independently attachable to and removable from a single backing ring of the retaining ring. This permits the backing ring to be made of a less expensive material or to be reused.

Figure 1:
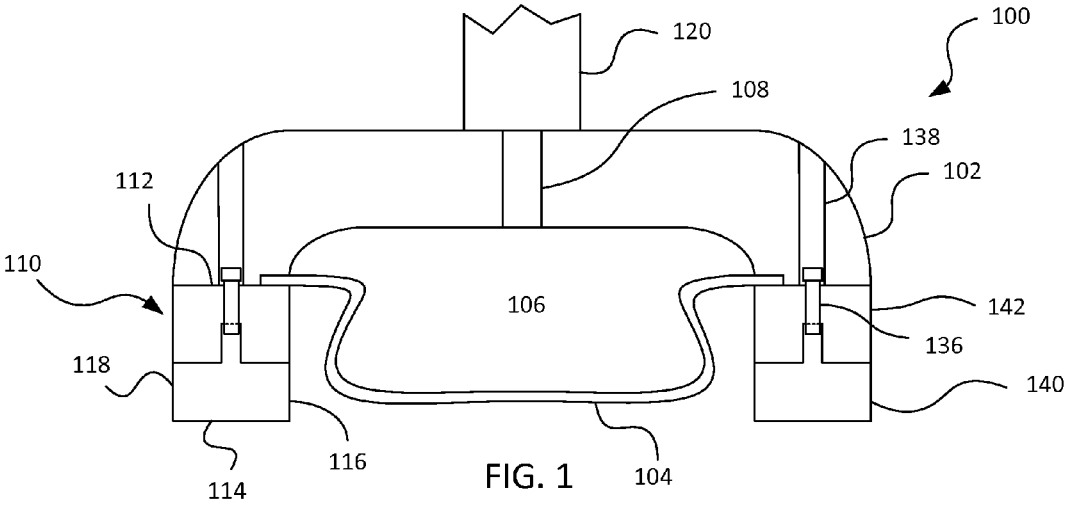
FIG. 1 is a schematic cross-sectional view of a carrier head.

During a polishing operation, one or more substrates can be polished by a chemical mechanical polishing (CMP) apparatus that includes a carrier head 100. Referring to FIG. 1, an exemplary simplified carrier head 100 includes a housing 102, a flexible membrane 104 that provides a mounting surface for the substrate, a pressurizable chamber 106 between the membrane 104 and the housing 102, and a retaining ring 110 secured near the edge of the housing 102 to hold the substrate below membrane 104. Although FIG. 1 illustrates the membrane 104 as clamped between the retaining ring 110 and the base 102, one or more other parts, e.g., clamp rings, could be used to hold the membrane 104. A drive shaft 120 can be provided to rotate and/or translate the carrier head across a polishing pad. A pump may be fluidly connected to the chamber 106 though a passage 108 in the housing to control the pressure in the chamber 106 and thus the downward pressure of the flexible membrane 104 on the substrate.

The retaining ring 110 may be a generally annular ring secured at the outer edge of the base 102, e.g., by threaded fasteners 136, e.g., screws or bolts, that extend through passages 138 in the base 102 into aligned threaded receiving recesses 139. In some implementations, the drive shaft 120 can be raised and lowered to control the pressure of a bottom surface 114 of the retaining ring 110 on a polishing pad. Alternatively, the base 120 and the carrier head 100 can include an internal chamber which can be pressurized to control a downward pressure on the retaining ring, e.g., as described in U.S. Pat. No. 6,183,354 or 7,575,504, which are incorporated by reference. For example, the base 102 and retaining ring 110 can be movable together relative to the drive shaft. As another example, the retaining ring 110 can be vertically movable relative to the base 102.

A distinguishing feature of a retaining ring is that it is removable from the base 102 (and the rest of the carrier head) as a unit. In the case of the retaining ring 110, this means that an upper portion 142 of the retaining ring 110 remains secured to a lower portion 140 of the retaining ring while the retaining ring 110 is removed, without requiring disassembly of the base 102 or removal of the base 102 from the carrier head 100.

An inner surface 116 of retaining ring 110 defines, in conjunction with the lower surface of the flexible membrane 104, a substrate receiving recess. The retaining ring 110 prevents the substrate from escaping the substrate receiving recess.

Figure 2:
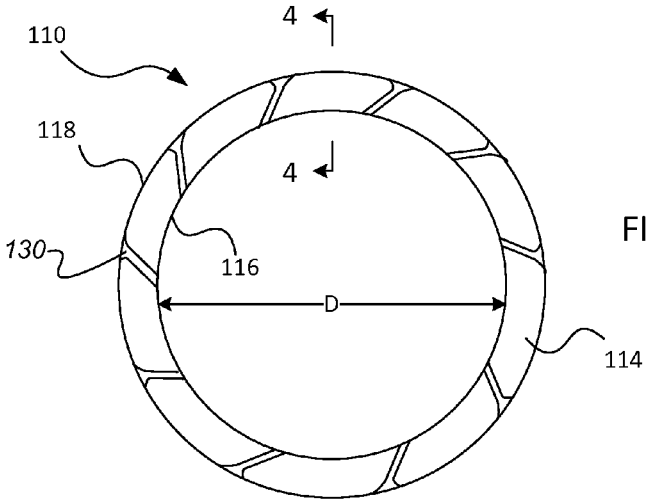
FIG. 2 is a bottom view of a retaining ring.
Figure 3:
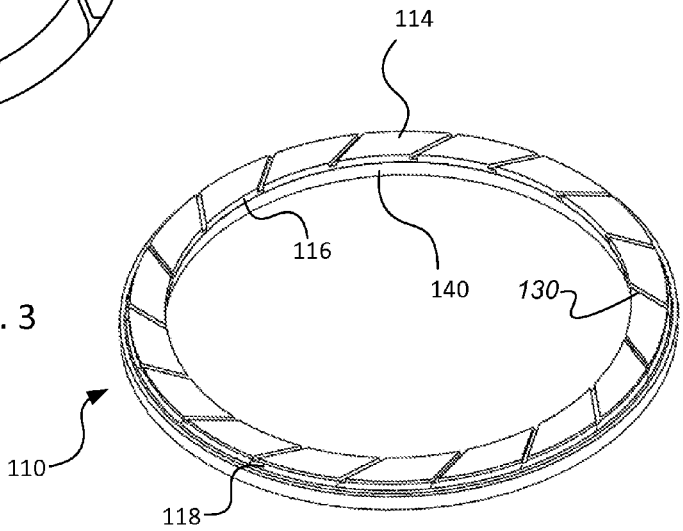
FIG. 3 is a bottom perspective view of a retaining ring.

The bottom surface 114 of the retaining ring 110 can be substantially flat, or as shown in FIGS. 2 and 3, in some implementations it may have a plurality of channels 130 that extend from the inner surface 116 to the outer surface 118 of the retaining ring to facilitate the transport of slurry from outside the retaining ring to the substrate. The channels 130 can be evenly spaced around the retaining ring. In some implementations, each channel 130 can be offset at an angle, e.g., 45°, relative to the radius passing through the channel. In some implementations, the channels are flared at the outer surface of the retaining ring. In some implementations, the channels are of uniform width along their length.

Figure 4:
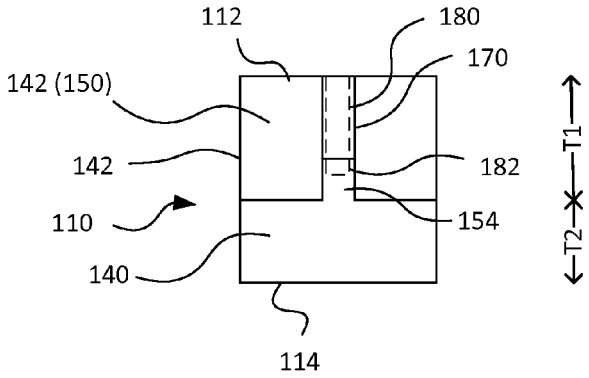
FIG. 4 is a cross-sectional view of a retaining ring.
Figure 5:
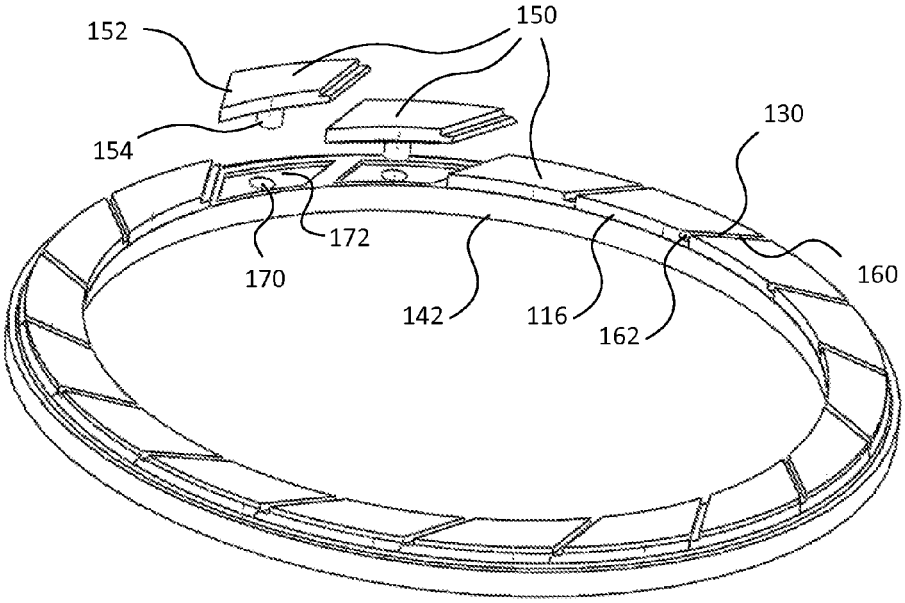
FIG. 5 is an exploded bottom perspective view of a retaining ring.

Referring to FIGS. 4 and 5, the retaining ring 110 includes the annular lower portion 140 having the bottom surface 114 that can contact the polishing pad, and the annular upper portion 142 connected to base 104. The lower portion 140 includes a plurality of individual arcuate segments 150. The arcuate segments 150 that provide the annular lower portion 140 are individually removably secured to upper portion 142. The annular upper portion 142 thus provides a backing ring to which the arcuate segments 150 are attached. Each arcuate segment 150 that forms the lower portion 140 can be substantially identical shape and material composition.

Figure 6A:
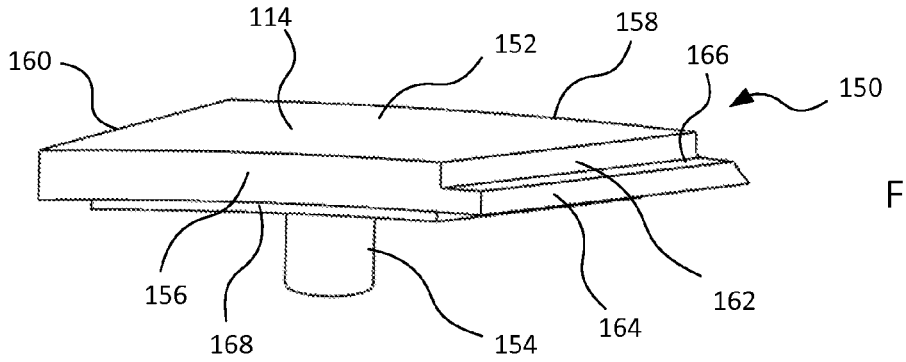
FIGS. 6A-6C are side perspective, bottom perspective and top perspective views, respectively, of a segment from the retaining ring.
Figure 6B:
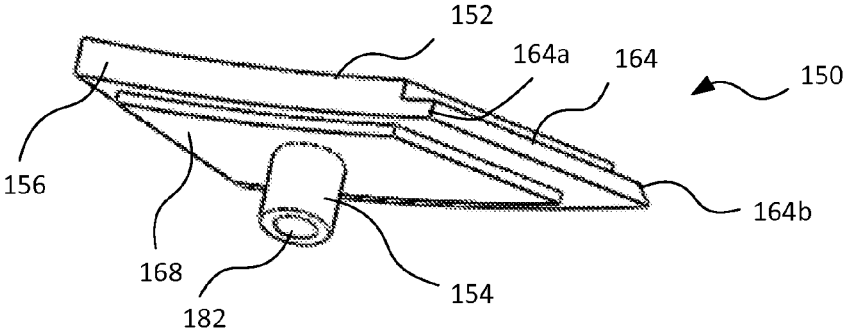
Figure 6C:
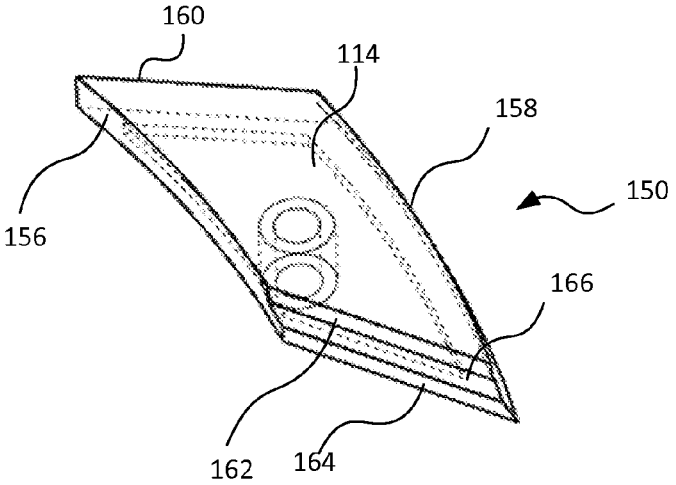

Referring to FIGS. 6A-6C, each arcuate segment 150 includes a main body 152 and a projection 154. A planar surface of the main body 152 provides the lower surface 114. The projection 154, e.g., a cylindrical shank, extends from a side of the main body 152 opposite the lower surface 114. The projection 154 can extend substantially normal to the bottom surface 114. When the retaining ring 110 is assembled, each projection 154 will fit into a corresponding aperture 170 in the upper portion 142 (See FIGS. 4 and 5).

The main body 152 of the arcuate segment 150 includes a curved inner surface 156 and a curved outer surface 158. In the assembled retaining ring, the curved inner surfaces 156 of the segments 150 together provide the cylindrical inner surface 116 (see FIG. 5) for retaining the substrate.

The main body 152 of the arcuate segment 150 also includes side surfaces 160, 162 on opposite sides of the main body 152. Each side surface 160, 162 extends from the curved inner surface 156 to the curved outer surface 158. In the assembled retaining ring, for each arcuate segment, the side surface 160 of the arcuate segment 150 will abut the side surface 162 of the adjacent arcuate segment 150 (see FIG. 5).

Returning to FIG. 5, in some implementations, there is one arcuate segment 150 for each channel 130. For example, each arcuate segment 150 can extend between two adjacent channels 130.

In some implementations, the side surfaces 160, 162 are shaped so that abutting side surfaces form the channel 130. For example, as shown in FIGS. 6A-6C, one of the side surfaces, e.g., side surface 162, includes a ledge 164. The ledge 164 can extend along the entire side surface 162 from the inner surface 156 to the outer surface 158. A lower surface 166 of the ledge 164 is recessed relative to the bottom surface 114, such that when the ledge 164 abuts the side surface 160 of the adjacent segment, the recessed lower surface 166 forms the channel 130.

In some implementations, an edge 164*a* of the ledge 164 at the inner surface 156 is at a different angle relative to vertical than an edge 164*b* of the ledge 164 at the outer surface 158. For example, the edge 164*a* of the ledge 164 at the inner surface 146 can be vertical, whereas the edge 164*b* of the ledge 164 at the outer surface 158 is sloped outwardly from top to bottom. However, in some implementations, the edges 164*a*, 164*b* are at the same angle relative, e.g., vertical.

Other implementations are possible, e.g., ledges could project from both side surfaces and the two ledges of adjacent segments could abut to provide the channel, or the channel could be formed by a groove the middle of a segment and the side surfaces could be simple planar surfaces that abut.

Optionally, the surface of the main body 152 farther from the bottom surface 114 can include a raised portion 168. The raised portion 168 can have a lower height than the projection 154. The raised portion 168 can surround the projection 154, or be spaced apart from the projection 154. When the retaining ring 110 is assembled, each raised portion 158 will fit into a corresponding recess 172 in the lower surface of the upper portion 142 (See FIGS. 4 and 5).

Figure 7A:
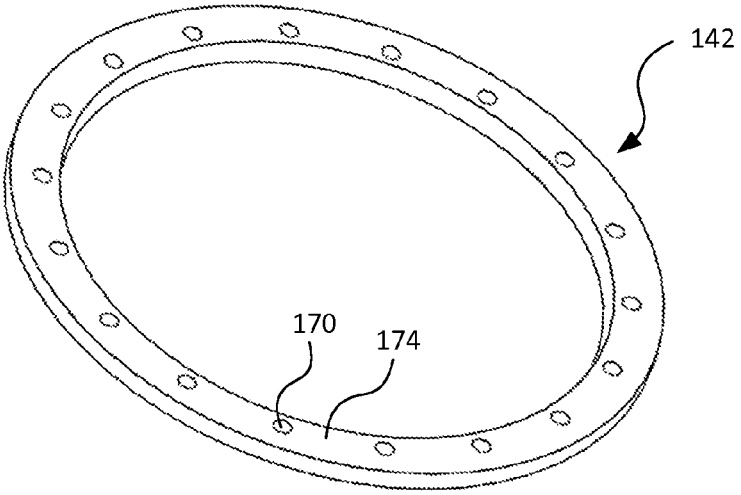
FIGS. 7A and 7B are top perspective and bottom perspective views, respectively, of a backing ring from the retaining ring. Like reference symbols in the various drawings indicate like elements.
Figure 7B:
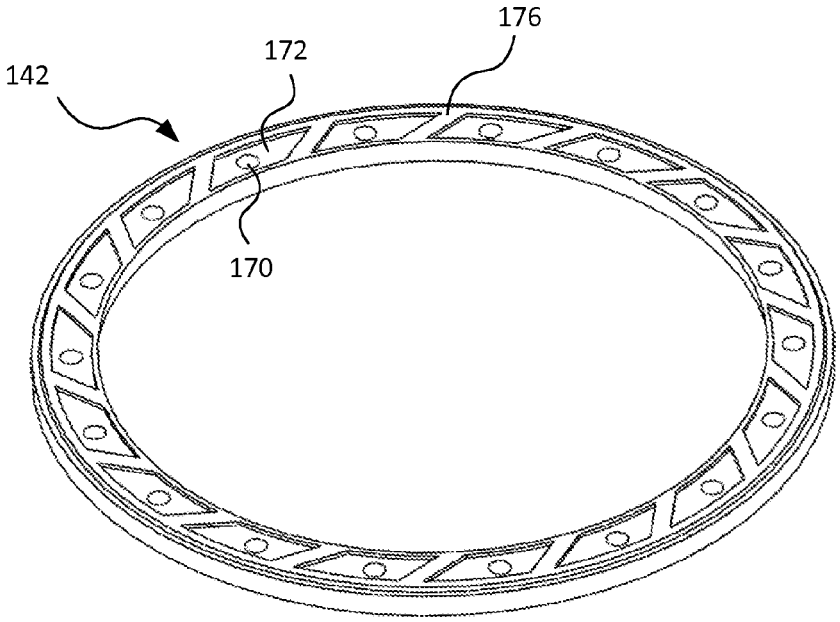

Referring to FIGS. 7A-7B, the backing ring 142 includes a plurality of apertures 170 that extend through the backing ring 142 from a top surface 174 to a lower surface 176. The number of apertures 170 can equal the number of segments 150 that will be attached to the backing ring 142. On the lower surface 176 of the backing ring, a recessed region 172 can surround each segment aperture 170. The apertures 170 and recessed regions 172 can be spaced at equal angular intervals around the backing ring 142. In some implementations, the backing ring 142 is a single unitary body of uniform composition.

As noted above, when assembled, the projection 154 of each segment 150 fits into a corresponding aperture 170 and the raised portion 168 of the segment fits into a corresponding recess 172 (see FIGS. 5 and 6B).

Referring to FIGS. 4 and 6B, to secure each segment 150 to the backing ring 142, a threaded fastener 180, e.g., a screw, can extend through the aperture 170 in the backing ring and into a receiving recess 182 in the projection 154. Both the inner surfaces of the receiving recess 182 and the aperture 170 can be threaded, so that threaded fastener 180 engages the threads aperture 170 and the recess 182.

In some implementations, some or all of the threaded fasteners 180 extend through the base to secure the segment 150 to the backing ring 152 and secure the retaining ring 110 to the carrier head. Thus, some or all of the threaded fasteners 180 can be provided by the threaded fasteners 136 (see FIG. 1). Alternatively, different threaded fasteners could be used. In some implementations, an adhesive is used in addition to the threaded fasteners to attach to attach the segments 150 to the backing ring 152.

The upper portion 142 of retaining ring 110 can be the same material as the arcuate segments 150, or can be a different material. The material of the upper portion 142 has about the same rigidity as the material of the arcuate segments 150, or is more rigid (i.e., has a higher elastic modulus). For example, each arcuate segment 150 can be (e.g., consist of) a plastic, e.g., polyphenol sulfide (PPS), polyaryletherketone (PAEK), polyetheretherketone (PEEK) or polyetherketoneketone (PEKK). An advantage of polyphenol sulfide (PPS) is that it is reliable and commonly used material for retaining rings. The upper portion 142 can be a metal, e.g., stainless steel or aluminum, or a different second plastic, e.g., polyvinyl chloride (PVC), polypropylene (PP), or polycarbonate (PC).

The plastic of the arcuate segments 150 of the lower portion 140 is chemically inert in a CMP process. In addition, the lower portion 140 should be sufficiently elastic that contact of the substrate edge against the retaining ring does not cause the substrate to chip or crack. On the other hand, the lower portion 140 should be sufficient rigid to have sufficient lifetime under wear from the polishing pad (on the bottom surface) and substrate (on the inner surface). The plastic of the lower portion 140 can have a durometer measurement of about 80-95 on the Shore D scale. In general, the elastic modulus of the material of lower portion 180 can be in the range of about $0.3\text{-}1.0\times10^6$ psi. Although the lower portion can have a low wear rate, it is acceptable for the lower portion 140 to be gradually worn away, as this appears to prevent the substrate edge from cutting a deep grove into the inner surface 118.

The thickness $T_1$ of the lower portion 140 should be larger than the thickness $T_S$ of substrate 10. Specifically, the lower portion should be thick enough that the substrate does not contact the adhesive layer when the substrate 10 is chucked by the carrier head. On the other hand, if the lower portion 140 is too thick, the bottom surface of the retaining ring 110 will be subject to deformation due to the flexible nature of the lower portion. The initial thickness of lower portion 140 may be about 50 to 1000 mils, e.g., 100 to 400 mils, depending on the needs of the manufacture and the desired replacement frequency. The lower portion may be replaced when the channels 130 have been worn.

The inner surface 116 of the lower portion 140 of the retaining ring can have an inner diameter D (see FIG. 2) just larger than the substrate diameter, e.g., about 1-2 mm larger than the substrate diameter, so as to accommodate positioning tolerances of the substrate loading system. The retaining ring 110 can have a radial width of about half an inch.

In some implementations, the thickness $T_2$ of lower portion 140 can be greater than the initial thickness $T_1$ of upper portion 142. However, this is not required; a manufacturer could have a retaining ring 110 in which the thickness $T_2$ of lower portion 140 is equal to or less than the initial thickness $T_1$ of upper portion 142. An advantage of the thickness $T_2$ of upper portion 142 being less than the initial thickness $T_1$ of lower portion 140 is increased lifetime of the retaining ring.

The upper surface 112 of the upper portion 142 can include a plurality of threaded receiving recesses 139. In some implementations, the threaded receiving recesses 139 extend partially, but not entirely through the upper portion 142. However, in some implementations, the threaded receiving recesses 139 extend entirely through the upper portion 142 and into the lower portion 140. The threaded receiving recesses 139 can be spaced apart at equal angular intervals about the retaining ring 110. The threads of the receiving recesses 139 could be machined directly from the second plastic material of the upper portion 142, or could be provided by screw sheaths inserted into holes.

When the upper and lower portions 142, 140 of the retaining ring 110 are joined, the upper surface of the lower portion 140 is positioned adjacent to the lower surface of the upper portion 142. The two portions generally have substantially the same dimensions at the inner and outer diameters on their adjacent surfaces such that the upper and lower portions 142, 140 form a flush surface where they meet when they are joined.

The individual segments 150 lack any aperture that extends from the top surface to the bottom surface of the segment.

In some implementations, the retaining ring 110 has one or more through holes that extend horizontally or at a small angle from horizontal through the body of the retaining ring from the inner diameter to the outer diameter for allowing fluid, e.g., air or water, to pass from the interior to the exterior, or from the exterior to the interior, of the retaining ring during polishing. The through-holes can extend through the upper portion 142. The through holes can be evenly spaced around the retaining ring.

Although the side walls of the retaining ring 110 are illustrated as purely vertical, the retaining ring 110 can include other features, such as a lip or recess on the outer surface to assist in centering the retaining ring in a substrate loader or to provide a hard stop for the retaining ring against the top inner edge of a surrounding ring, and the inner or outer surface of the retaining ring 110 can be slightly tapered (although the upper and lower portions 142, 140 can still form a flush surface where they meet).

The present invention has been described in terms of a number of embodiments. The invention, however, is not limited to the embodiments depicted and described. Rather, the scope of the invention is defined by the appended claims.

What is claimed is:

1. A retaining ring, comprising:

a generally annular upper portion having a top surface configured to be connected to a base of a carrier head and a lower surface; and a plurality of substantially identical physically separate arcuate segments, each of the arcuate segments detachably secured to the upper portion by an independent threaded fastener to form an annular lower portion with each arcuate segment independently removable from the upper portion by removal of the threaded fastener, each of the arcuate segments having an upper surface that abuts the lower surface of the upper portion and a bottom surface for contacting a polishing pad during polishing.

2. A retaining ring, configuring:

a generally annular upper portion having a top surface configured to be connected to a base of a carrier head and a lower surface; and a plurality of substantially identical physically separate arcuate segments detachably secured to and independently removable from the upper portion to form an annular lower portion, each of the arcuate segments having an upper surface that abuts the lower surface of the upper portion and a bottom surface for contacting a polishing pad during polishing;

wherein the upper portion comprises a plurality of apertures, and each of the arcuate segments includes a projection extending from the upper surface into an aperture of the plurality of apertures.

3. The retaining ring of claim 2, further comprising a threaded fastener inserted into the aperture.

4. The retaining ring of claim 3, wherein the fastener engages a threaded recess in the projection.

5. The retaining ring of claim 2, wherein the projection comprises a cylindrical shank.

6. The retaining ring of claim 2, wherein the upper portion comprises a plurality of recesses, and each of the arcuate segments includes a raised portion that engages a recess of the plurality of recesses.

7. The retaining ring of claim 6, wherein the raised portion surrounds the projection.

8. The retaining ring of claim 1, wherein the retaining ring comprises a plurality of slurry-transport channels, and there is one arcuate segment for each slurry transport channel.

9. The retaining ring of claim 8, wherein each arcuate segment extends between two adjacent slurry transport channels.

10. The retaining ring of claim 9, wherein at least one side surface of the each arcuate segment includes a ledge with a lower surface that is recessed relative to the bottom surface.

11. The retaining ring of claim 1, wherein each arcuate segment is a first material and the upper portion is a different second material.

12. The retaining ring of claim 11, wherein the second material is more rigid than the first material.

13. The retaining ring of claim 1, wherein each arcuate segment is a plastic selected from the group consisting of polyphenylene sulfide (PPS), polyaryletherketone (PAEK), polyetheretherketone (PEEK) and polyetherketoneketone (PEKK).

14. The retaining ring of claim 1, wherein the lower portion lacks any aperture from the top surface to the bottom surface of the lower portion.

15. The retaining ring of claim 1, wherein the top surface of the upper portion includes a hole to receive a fastener to mechanically affix the retaining ring to the base.

16. The retaining ring of claim 6, wherein a perimeter of the raised portion is spaced by substantially uniform distance from an edge of the upper surface.

17. A retaining ring, comprising:

a generally annular upper portion having a top surface configured to be connected to a base of a carrier head and a lower surface; and a plurality of substantially identical physically separate arcuate segments detachably secured to and independently removable from the upper portion to form an annular lower portion, each of the arcuate segments having an upper surface that abuts the lower surface of the upper portion and a bottom surface for contacting a polishing pad during polishing;

wherein at least one side surface of each arcuate segment includes a ledge with a lower surface that is recessed relative to the bottom surface.

18. The retaining ring of claim 17, wherein the ledge of each arcuate segment abuts an adjacent arcuate segment of the plurality of arcuate segments.

19. The retaining ring of claim 17, wherein an edge of the ledge adjacent an inner surface of the retaining ring is at a different angle relative to vertical than an edge of the ledge adjacent an outer surface of the retaining ring.

20. The retaining ring of claim 17, wherein each arcuate segment includes a first side surface and a second side surface on a side of the arcuate segment opposite the first side surface, and both of the first side surface and the second side surface include a ledge with a lower surface that is recessed relative to the bottom surface.

21. The retaining ring of claim 1, wherein the lower surface of the upper portion includes a plurality of recesses, and a portion of each arcuate segment fits into a recess of the plurality of recesses.

* * * * *

UNITED STATES PATENT AND TRADEMARK OFFICE

CERTIFICATE OF CORRECTION

PATENT NO. : 9,227,297 B2
APPLICATION NO. : 14/219913
DATED : January 5, 2016
INVENTOR(S) : Irfanulla Khuddus Rahmathullah et al.

It is certified that error appears in the above-identified patent and that said Letters Patent is hereby corrected as shown below:

Claims

In Claim 2, column 6, line 59, delete "configuring:" and insert -- comprising: --.

Signed and Sealed this
Nineteenth Day of April, 2016

Michelle K. Lee

Michelle K. Lee
*Director of the United States Patent and Trademark Office*